US006743468B2

(12) United States Patent
Fuller et al.

(10) Patent No.: US 6,743,468 B2
(45) Date of Patent: Jun. 1, 2004

(54) METHOD OF COATING WITH COMBINED KINETIC SPRAY AND THERMAL SPRAY

(75) Inventors: Brian K. Fuller, Rochester Hills, MI (US); Thomas H. Van Steenkiste, Ray, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/417,495

(22) Filed: Apr. 17, 2003

(65) Prior Publication Data

US 2004/0058064 A1 Mar. 25, 2004

Related U.S. Application Data

(63) Continuation of application No. 10/252,203, filed on Sep. 23, 2002, now abandoned.

(51) Int. Cl.[7] ..... B05D 3/02

(52) U.S. Cl. ..... 427/191; 427/180; 427/201; 427/203; 427/205; 427/404; 427/405; 427/407.1; 427/408; 427/409; 427/411; 427/412.1; 427/422; 427/427; 427/600

(58) Field of Search ..... 427/422, 427, 427/404, 405, 407.1, 409, 411, 412.1, 408, 600, 180, 191, 201, 203, 205

(56) References Cited

U.S. PATENT DOCUMENTS

| | | | |
|---|---|---|---|
| 3,100,724 | A | 8/1963 | Rocheville |
| 3,993,411 | A | 11/1976 | Babcock et al. |
| 4,263,335 | A | 4/1981 | Wagner et al. |
| 4,606,495 | A | 8/1986 | Stewart, Jr. et al. |
| 4,891,275 | A | 1/1990 | Knoll |
| 4,939,022 | A | 7/1990 | Palanisamy |
| 5,187,021 | A | 2/1993 | Vydra et al. |
| 5,271,965 | A | 12/1993 | Browning |
| 5,302,414 | A | 4/1994 | Alkhimov et al. |
| 5,308,463 | A | 5/1994 | Hoffmann et al. |
| 5,340,015 | A | 8/1994 | Hira et al. |
| 5,395,679 | A | 3/1995 | Myers et al. |
| 5,424,101 | A | 6/1995 | Atkins et al. |
| 5,464,146 | A | 11/1995 | Zalvzec et al. |
| 5,476,725 | A | 12/1995 | Papich et al. |
| 5,527,627 | A | 6/1996 | Lautzenhiser et al. |
| 5,593,740 | A | 1/1997 | Strumban et al. |
| 5,648,123 | A | 7/1997 | Kuhn et al. |
| 5,795,626 | A | 8/1998 | Gabel et al. |
| 5,854,966 | A | 12/1998 | Kampe et al. |
| 5,875,626 | A | 3/1999 | Cromartie |
| 5,894,054 | A | 4/1999 | Poruchuri et al. |
| 5,907,761 | A | 5/1999 | Tohma et al. |
| 5,952,056 | A | 9/1999 | Jordan et al. |
| 5,965,193 | A | 10/1999 | Ning et al. |

(List continued on next page.)

OTHER PUBLICATIONS

Van Steenkiste, et al; *Kinetic Spray Coatings*; in Surface & Coatings Technology III; 1999; pp. 62–71.

(List continued on next page.)

*Primary Examiner*—Bernard Pianalto
(74) *Attorney, Agent, or Firm*—Scott A. McBain

(57) ABSTRACT

Disclosed is a system and a method for applying both a kinetic spray applied coating layer and a thermal spray applied layer onto a substrate using a single application nozzle. The system includes a higher heat capacity gas heater to permit oscillation between a kinetic spray mode wherein the particles being applied are not thermally softened and a thermal spray mode wherein the particles being applied are thermally softened prior to application. The system increases the versatility of the spray nozzle and addresses several problems inherent in kinetic spray applied coatings.

20 Claims, 3 Drawing Sheets

U.S. PATENT DOCUMENTS

| | | | |
|---|---|---|---|
| 5,989,310 | A | 11/1999 | Chu et al. |
| 6,033,622 | A | 3/2000 | Maruyama |
| 6,051,045 | A | 4/2000 | Narula et al. |
| 6,051,277 | A | 4/2000 | Claussen et al. |
| 6,074,737 | A | 6/2000 | Jordan et al. |
| 6,129,948 | A | 10/2000 | Plummet et al. |
| 6,139,913 | A | 10/2000 | Van Steenkiste et al. |
| 6,283,386 | B1 | 9/2001 | Van Steenkiste et al. |

OTHER PUBLICATIONS

Liu, et al; *Recent Development in the Fabrication of Metal Matrix–Particulate Composites Using Powder Metallurgg Tecniques*; in Journal of Material Science 29; 1994; pp. 1999–2007; National University of Singapore, Japan, (no month avail.).

Papyrin; *The Cold Gas–Dynamic Spraying Method a New Method for Coatings Deposition Promises a New Generation of Technologies; Novosibirsk, Russia*, (no date avail.).

McCune, al; Characterization of Copper and Steel Coatings Made by the Cold Gas–Dynamic Spray Method; National Thermal Spray Conference, (no date avail.).

Alkhimov, et al; *A Method of "Cold" Gas–Dynamic Deposition; Sav. Phys. Kokl.* 36(*12; Dec. 1990; pp. 1047–1049*.

Dykuizen, et al; *Impact of High Velocity Cold Spray Particles*; in Journal of Thermal Spray Technology 8(4); 1999; pp. 559–564, (no month avail.).

Swartz, et al; *Thermal Resistance At Interfaces; Appl. Phys. Lett., vol. 51, No. 26,28; Dec. 1987; pp. 2201–2202*.

Davis, et al; *Thermal Conductivity of Metal–Matrix Composiites; J.Appl. Phys. 77* (*10*), *May 15, 1995; pp. 4494–4960*.

Stoner et al; *Measurements of the Kapitza Conductance between Diamond and Several Metals*; Physical Review Letters, vol. 68, No. 10; Mar. 9, 1992; pp. 1563–1566.

Stoner et al; *Kapitza conductance and heat flow between solids at temperatures from 50 to 300K*; Physical Review B, vol. 48, No. 22, Dec. 1, 1993–II; pp. 16374;16387.

Johnson et al; *Diamond/Al metal matrix composites formed by the pressureless metal infiltration process*; J. Mater, Res., vol. 8, No. 5, May 1993; pp. 11691173.

Rajan et al; *Reinforcement coatings and interfaces in Aluminium Metal Matrix Composites*; pp. 3491–3503, (no date avail.).

*LEC Manufacturing and Engineering Capabilities*; Lanxide Electronic Components, Inc., (no date avail.).

*Dykhuizen et al; Gas Dynamic Priniciples of Cold Spray*; Journal of Thermal Spray Technology; 06–98; pp. 205–212, (no month avail.).

*McCune et al; An Exploration of the Cold Gas–Dynamic Spray Method For Several Materials Systems*,(no date avail.).

Ibrahim et al; *Particulate Reinforced Metal Matrix Composites—A Review; Journal of Matrials Science 26; pp. 1137–1156*,(no date avail.).

METHOD OF COATING WITH COMBINED KINETIC SPRAY AND THERMAL SPRAY

This is a continuation of application Ser. No. 10/252,203 filed Sep. 23, 2002 now abandoned.

TECHNICAL FIELD

The present invention is a method and an apparatus for applying a coating to a substrate, and more particularly, to a method and an apparatus for applying both a kinetic spray coating and a thermal spray coating from the same nozzle.

BACKGROUND OF THE INVENTION

A new technique for producing coatings on a wide variety of substrate surfaces by kinetic spray, or cold gas dynamic spray, was recently reported in articles by T. H. Van Steenkiste et al., entitled "kinetic Spray Coatings," published in Surface and Coatings Technology, vol. 111, pages 62–71, Jan. 10, 1999 and "Aluminum coatings via kinetic spray with relatively large powder particles" published in Surface and Coatings Technology 154, pages 237–252, 2002. The articles discuss producing continuous layer coatings having low porosity, high adhesion, low oxide content and low thermal stress. The articles describe coatings being produced by entraining metal powders in an accelerated air stream, through a converging-diverging de Laval type nozzle and projecting them against a target substrate. The particles are accelerated in the high velocity air stream by the drag effect. The air used can be any of a variety of gases including air or helium. It was found that the particles that formed the coating did not melt or thermally soften prior to impingement onto the substrate. It is theorized that the particles adhere to the substrate when their kinetic energy is converted to a sufficient level of thermal and mechanical deformation. Thus, it is believed that the particle velocity must be high enough to exceed the yield stress of the particle to permit it to adhere when it strikes the substrate. It was found that the deposition efficiency of a given particle mixture was increased as the inlet air temperature was increased. Increasing the inlet air temperature decreases its density and increases its velocity. The velocity varies approximately as the square root of the inlet air temperature. The actual mechanism of bonding of the particles to the substrate surface is not fully known at this time. It is believed that the particles must exceed a critical velocity prior to their being able to bond to the substrate. The critical velocity is dependent on the material of the particle and to a lesser degree on the material of the substrate. It is believed that the initial particles to adhere to a substrate have broken the oxide shell on the substrate material permitting subsequent metal to metal bond formation between plastically deformed particles and the substrate. Once an initial layer of particles has been formed on a substrate subsequent particles bind not only to the voids between previous particles bound to the substrate but also engage in particle to particle bonds. The bonding process is not due to melting of the particles in the air stream because while the temperature of the air stream may be above the melting point of the particles, due to the short exposure time the particles are never heated to a temperature above their melt temperature. This feature is considered critical because the kinetic spray process allows one to deposit particles onto a surface with out a phase transition.

This work improved upon earlier work by Alkimov et al. as disclosed in U.S. Pat. No. 5,302,414, issued Apr. 12, 1994. Alkimov et al. disclosed producing dense continuous layer coatings with powder particles having a particle size of from 1 to 50 microns using a supersonic spray.

The Van Steenkiste articles reported on work conducted by the National Center for Manufacturing Sciences (NCMS) and by the Delphi Research Labs to improve on the earlier Alkimov process and apparatus. Van Steenkiste et al. demonstrated that Alkimov's apparatus and process could be modified to produce kinetic spray coatings using particle sizes of greater than 50 microns.

The modified process and apparatus for producing such larger particle size kinetic spray continuous layer coatings are disclosed in U.S. Pat. Nos. 6,139,913, and 6,283,386. The process and apparatus described provide for heating a high pressure air flow and combining this with a flow of particles. The heated air and particles are directed through a de Laval-type nozzle to produce a particle exit velocity of between about 300 m/s (meters per second) to about 1000 m/s. The thus accelerated particles are directed toward and impact upon a target substrate with sufficient kinetic energy to impinge the particles to the surface of the substrate. The temperatures and pressures used are sufficiently lower than that necessary to cause particle melting or thermal softening of the selected particle. Therefore, as discussed above, no phase transition occurs in the particles prior to impingement. It has been found that each type of particle material has a threshold critical velocity that must be exceeded before the material begins to adhere to the substrate by the kinetic spray process.

One difficulty associated with all of these prior art kinetic spray systems arises from defects in the substrate surface. When the surface has an imperfection in it the kinetic spray coating may develop a conical shaped defect over the surface imperfection. The conical defect that develops in the kinetic spray coating is stable and can not be repaired by the kinetic spray process, hence the piece must be discarded. A second difficulty arises when the substrate is a softer plastic or a soft ceramic composite. These materials can not be coated by a kinetic spray process because the particles being sprayed bury themselves below the surface rather than deforming and adhering to the surface.

SUMMARY OF THE INVENTION

In one embodiment, the present invention is a method of coating a substrate comprising the steps of: providing particles of a material to be sprayed; providing a supersonic nozzle having a throat located between a converging region and a diverging region, directing a flow of a gas through the nozzle, and injecting the particles into the nozzle and entraining the particles in the flow of the gas; maintaining the gas at a temperature insufficient to heat the particles to a temperature at or above their melting temperature in the nozzle and accelerating the particles to a velocity sufficient to result in adherence of the particles on a substrate positioned opposite the nozzle; and maintaining the gas at a temperature sufficiently high to heat the particles to a temperature at or above their melting temperature in the nozzle thereby melting the particles and entraining the molten particles in the flow of the gas and directing the entrained molten particles at a substrate positioned opposite the nozzle.

BRIEF DESCRIPTION OF THE DRAWINGS

The present invention will now be described, by way of example, with reference to the accompanying drawings, in which.

DESCRIPTION OF THE PREFERRED EMBODIMENT

The present invention comprises an improvement to the kinetic spray process as generally described in U.S. Pat. Nos. 6,139,913, 6,283,386 and the articles by Van Steenkiste, et al. entitled "kinetic Spray Coatings" published in Surface and Coatings Technology Volume III, Pages 62–72, Jan. 10, 1999, and "Aluminum coatings via kinetic spray with relatively large powder particles" published in Surface and Coatings Technology 154, pages 237–252, 2002 all of which are herein incorporated by reference.

Figure 1:
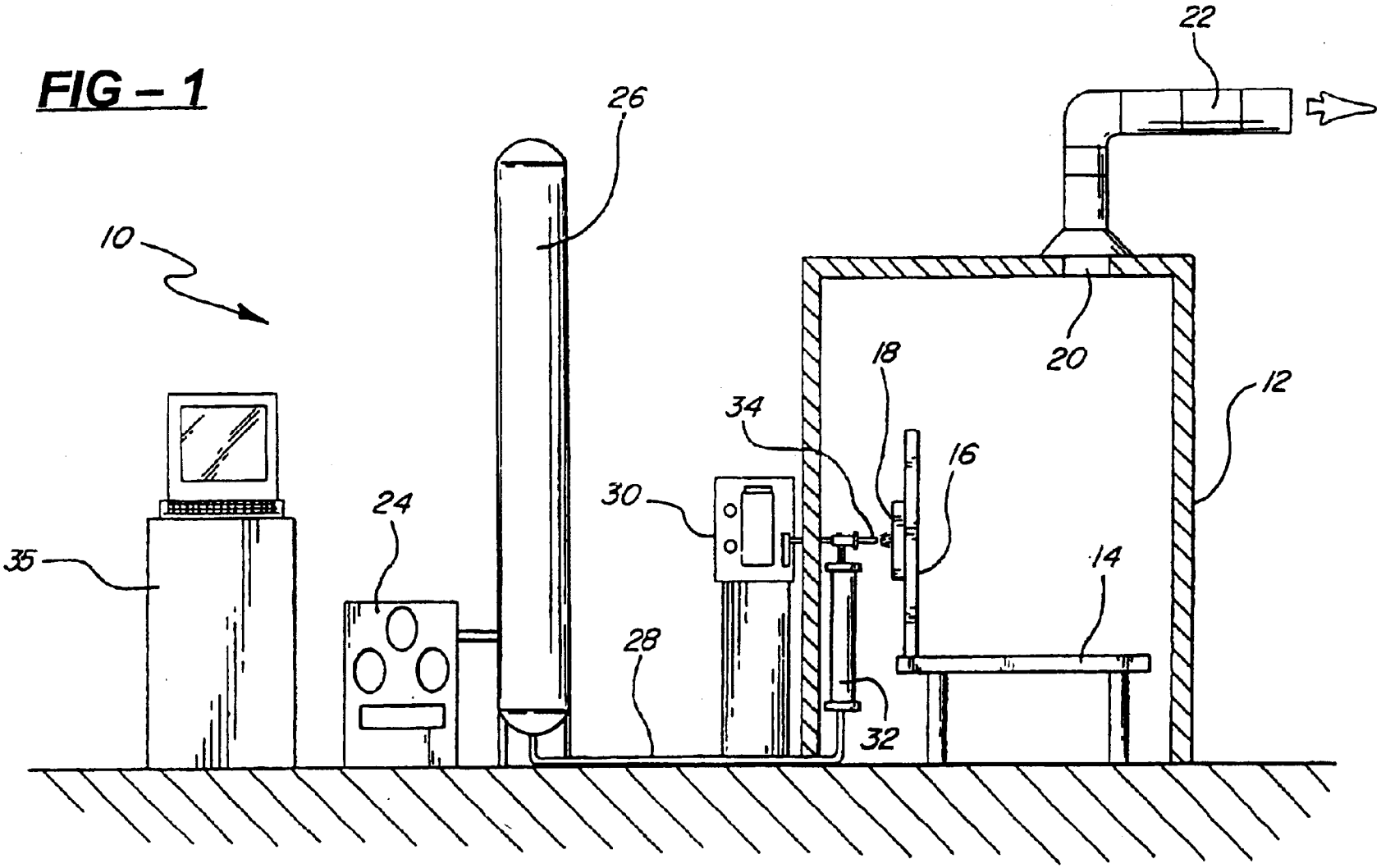
FIG. 1 is a generally schematic layout illustrating a kinetic spray system for performing the method of the present invention.

Referring first to FIG. 1, a kinetic spray system according to the present invention is generally shown at 10. System 10 includes an enclosure 12 in which a support table 14 or other support means is located. A mounting panel 16 fixed to the table 14 supports a work holder 18 capable of movement in three dimensions and able to support a suitable workpiece formed of a substrate material to be coated. The enclosure 12 includes surrounding walls having at least one air inlet, not shown, and an air outlet 20 connected by a suitable exhaust conduit 22 to a dust collector, not shown. During coating operations, the dust collector continually draws air from the enclosure 12 and collects any dust or particles contained in the exhaust air for subsequent disposal.

The spray system 10 further includes an air compressor 24 capable of supplying air pressure up to 3.4 MPa (500 psi) to a high pressure air ballast tank 26. The air ballast tank 26 is connected through a line 28 to both a powder feeder 30 and a separate air beater 32. The air heater 32 supplies high pressure heated air, the main gas described below, to a kinetic spray nozzle 34. The powder feeder 30 mixes particles of a spray powder with unheated air and supplies the mixture to a supplemental inlet line 48 of the nozzle 34. A computer control 35 operates to control both the pressure of air supplied to the air heater 32 and the temperature of the heated main gas exiting the air heater 32. The main gas can comprise air, argon, nitrogen helium and other inert gases.

Figure 2:
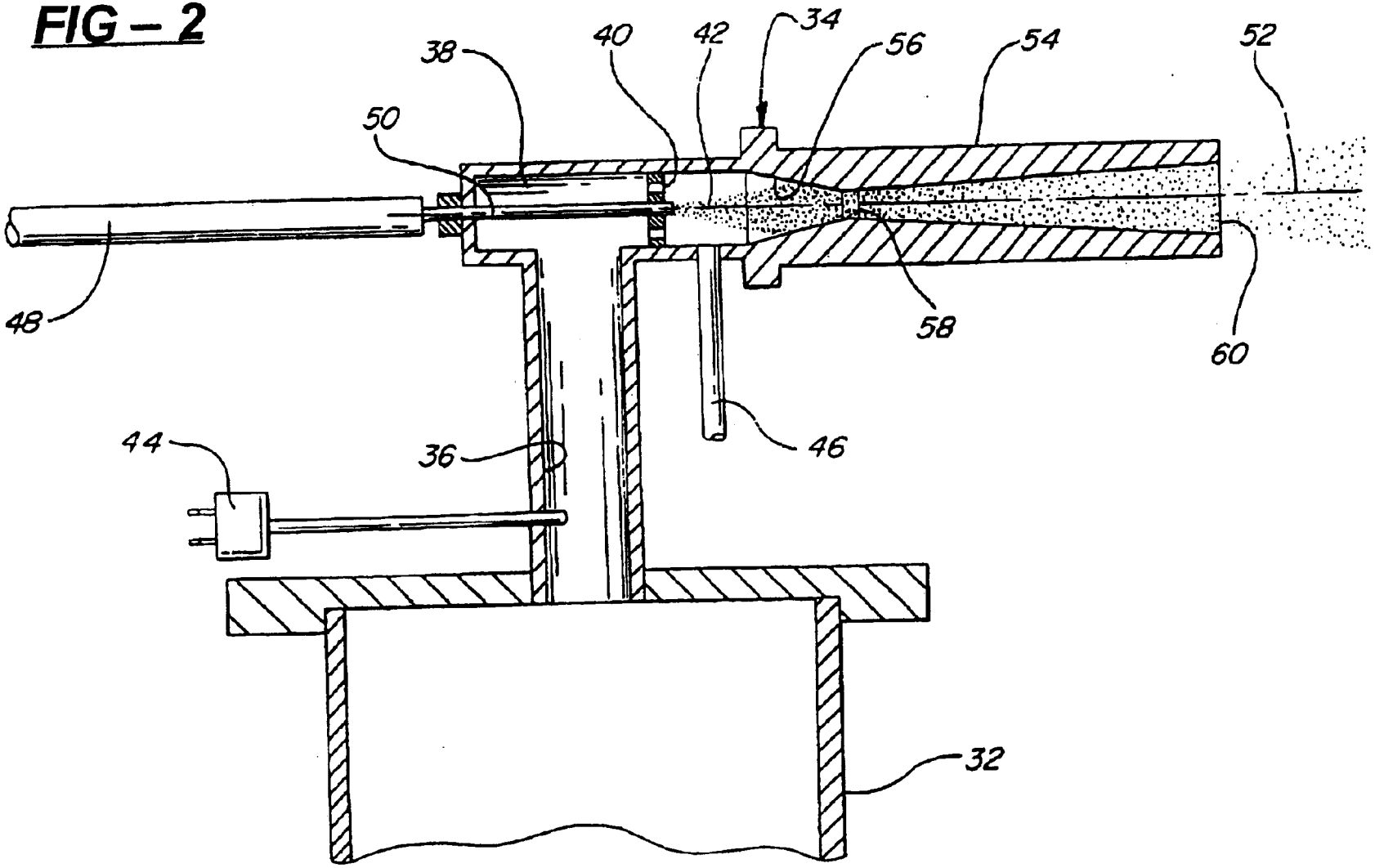
FIG. 2 is an enlarged cross-sectional view of one embodiment of a kinetic spray nozzle used in the system.

FIG. 2 is a cross-sectional view of one embodiment of the nozzle 34 and its connections to the air heater 32 and the supplemental inlet line 48. A main air passage 36 connects the air heater 32 to the nozzle 34. Passage 36 connects with a premix chamber 38 which directs air through a flow straightener 40 and into a mixing chamber 42. Temperature and pressure of the air or other heated main gas are monitored by a gas inlet temperature thermocouple 44 in the passage 36 and a pressure sensor 46 connected to the mixing chamber 42.

This embodiment of the nozzle 34 requires a high pressure powder feeder 30. With this nozzle 34 and supplemental inlet line 48 set up the powder feeder 30 must have pressure sufficient to overcome that of the heated main gas. The mixture of unheated high pressure air and coating powder is fed through the supplemental inlet line 48 to a powder injector tube 50 comprising a straight pipe having a predetermined inner diameter. When the particles have an average nominal diameter of from 50 to 106 microns it is preferred that the inner diameter of the tube 50 range from 0.4 to 3.0 millimeters. When larger particles of 106 to 250 microns are used it is preferable that the inner diameter of the tube 50 range from 0.40 to 0.90 millimeters. The tube 50 has a central axis 52 that is preferentially the same as the axis of the premix chamber 38. The tube 50 extends through the premix chamber 38 and the flow straightener 40 into the mixing chamber 42.

Mixing chamber 42 is in communication with the de Laval type supersonic nozzle 54. The nozzle 54 has an entrance cone 56 that forms a converging region which decreases in diameter to a throat 58. Downstream of the throat is a diverging region that ends in an exit end 60. The largest diameter of the entrance cone 56 may range from 10 to 6 millimeters, with 7.5 millimeters being preferred. The entrance cone 56 narrows to the throat 58. The throat 58 may have a diameter of from 3.5 to 1.5 millimeters, with from 3 to 2 millimeters being preferred. The portion of the nozzle 54 from downstream of the throat 58 to the exit end 60 may have a variety of shapes, but in a preferred embodiment it has a rectangular cross-sectional shape. When particles of from 50 to 106 microns are used the length from the throat 58 to the exit end 60 can range from 60.0 to 80.0 millimeters, however, when particles of from 106 to 250 microns are used then preferably the distance from the throat 58 to the exit end 60 ranges from 200.0 to 400.0 millimeters. At the exit end 60 the nozzle 54 preferably has a rectangular shape with a long dimension of from 8 to 14 millimeters by a short dimension of from 2 to 6 millimeters.

As disclosed in U.S. Pat. Nos. 6,139,913 and 6,283,386 the powder injector tube 50 supplies a particle powder mixture to the system 10 under a pressure in excess of the pressure of the heated main gas from the passage 36 using the nozzle 54 shown in FIG. 2. The nozzle 54 produces an exit velocity of the entrained particles of from 300 meters per second to as high as 1200 meters per second. The entrained particles gain kinetic and thermal energy during their flow through this nozzle 54. It will be recognized by those of skill in the art that the temperature of the particles in the gas stream will vary depending on the particle size and the main gas temperature. The main gas temperature is defined as the temperature of heated high-pressure gas at the inlet to the nozzle 54.

Figure 3:
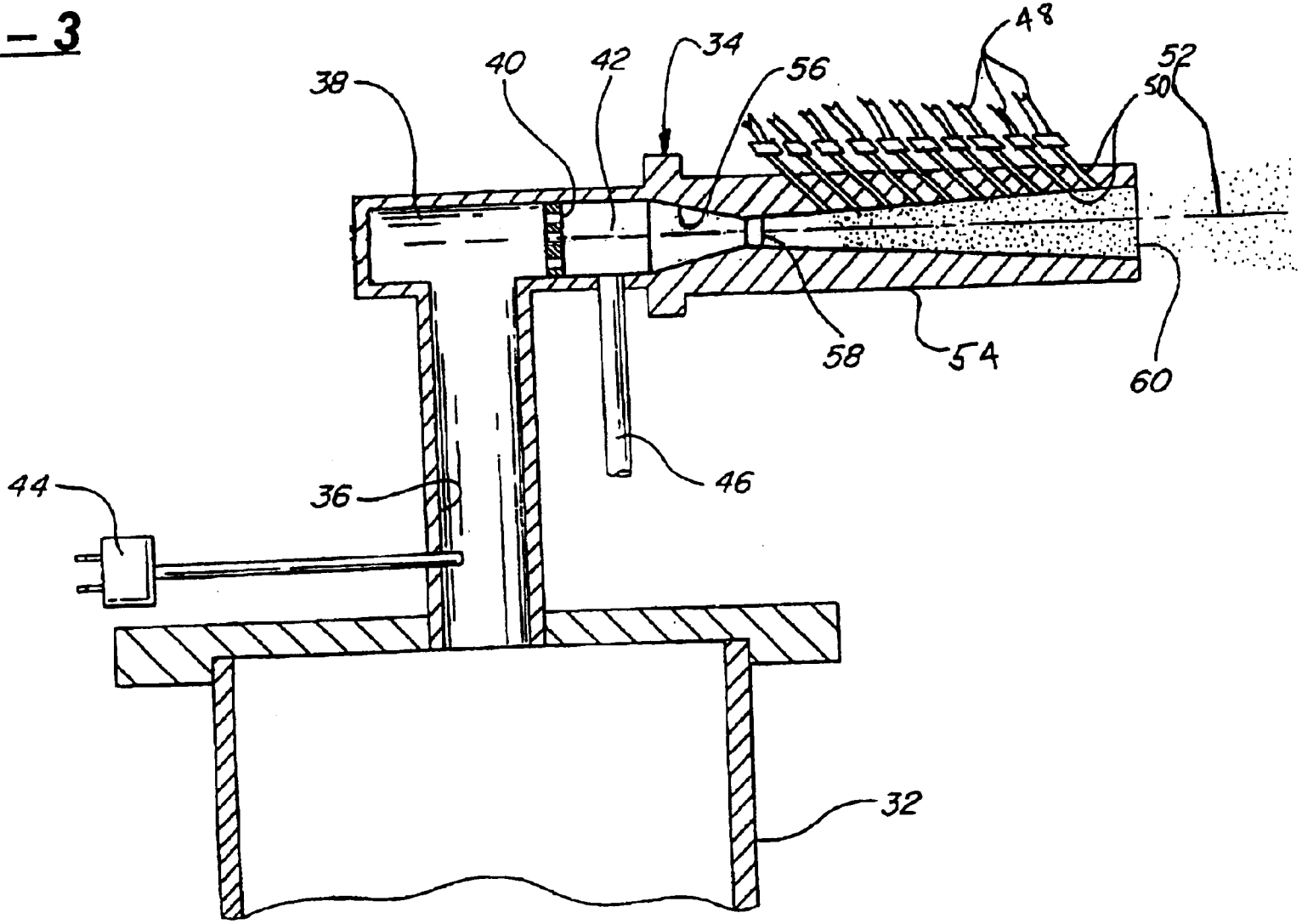
FIG. 3 is an enlarged cross-sectional view of an alternative embodiment of a kinetic spray nozzle used in the system.

FIG. 3 is a cross-sectional view of another embodiment of the nozzle 34 and its connections to the air heater 32 and the powder feeder 30. A main air passage 36 connects the air heater 32 to the nozzle 34. Passage 36 connects with a premix chamber 38 that directs air through a flow straightener 40 and into a chamber 42. Temperature and pressure of the air or other heated main gas are monitored by a gas inlet temperature thermocouple 44 in the passage 36 and a pressure sensor 46 connected to the chamber 42.

Chamber 42 is in communication with a de Laval type supersonic nozzle 54. The nozzle 54 has a central axis 52 and an entrance cone 56 that decreases in diameter to a throat 58. The entrance cone 56 forms a converging region of the nozzle 54. Downstream of the throat 58 is an exit end 60 and a diverging region is defined between the throat 58 and the exit end 60. The largest diameter of the entrance cone 56 may range from 10 to 6 millimeters, with 7.5 millimeters being preferred. The entrance cone 56 narrows to the throat 58. The throat 58 may have a diameter of from 3.5 to 1.5 millimeters, with from 3 to 2 millimeters being preferred. The diverging region of the nozzle 54 from downstream of the throat 58 to the exit end 60 may have a variety of shapes, but in a preferred embodiment it has a rectangular cross-sectional shape. At the exit end 60 the nozzle 54 preferably has a rectangular shape with a long dimension of from 8 to 14 millimeters by a short dimension of from 2 to 6 millimeters.

The de Laval nozzle 54 of FIG. 3 is modified from the embodiment shown in FIG. 2 in the diverging region. In this embodiment, a mixture of heated or unheated low pressure air and coating powder is fed from the powder feeder 30 through one of a plurality of supplemental inlet lines 48 each of which is connected to a powder injector tube 50 comprising a tube having a predetermined inner diameter, described above. For simplicity the actual connections between the powder feeder 30 and the inlet lines 48 are not shown. The injector tubes 50 supply the particles to the nozzle 54 in the diverging region downstream from the throat 58, which is a region of reduced pressure, hence, in this embodiment the powder feeder 30 can be a low pressure powder feeder, discussed below. The length of the nozzle 54 from the throat 58 to the exit end can vary widely and typically ranges from 100 to 400 millimeters.

As would be understood by one of ordinary skill in the art the number of injector tubes 50, the angle of their entry relative to the central axis 52 and their position downstream from the throat 58 can vary depending on any of a number of parameters. In FIG. 3 ten injector tubes 50 are show, but the number can be as low as one and as high as the available room of the diverging region. The angle relative to the central axis 52 can be any that ensures that the particles are directed toward the exit end 60, basically from 1 to about 90 degrees. It has been found that an angle of 45 degrees relative to central axis 52 works well. As for the embodiment of FIG. 2, the inner diameter of the injector tube 50 can vary between 0.4 to 3.0 millimeters. The use of multiple injector tubes 50 in this nozzle 54 permits one to easily modify the system 10. One can rapidly change particles by turning off a first powder feeder 30 connected to a first injector tube 50 and the turning on a second powder feeder 30 connected to a second injector tube 50. Such a rapid change over is not easily accomplished with the embodiment shown in FIG. 2. For simplicity only one powder feeder 30 is shown in FIG. 1, however, as would be understood by one of ordinary skill in the art, the system 10 could include a plurality of powder feeders 30. The nozzle 54 of FIG. 3 also permits one to mix a number of powders in a single injection cycle by having a plurality of powder feeders 30 and injector tubes 50 functioning simultaneously. An operator can also run a plurality of particle populations, each having a different average nominal diameter, with the larger population being injected closer to the throat 58 relative to the smaller size particle populations and still get efficient deposition. The nozzle 54 of FIG. 3 will permit an operator to better optimize the deposition efficiency of a particle or mixture of particles. For example, it is known that harder materials have a higher critical velocity, therefore in a mixture of particles the harder particles could be introduced at a point closer to the throat 58 thereby giving a longer acceleration time.

Using a de Laval nozzle 54 like that shown in FIG. 3 having a length of 300 millimeters from throat 58 to exit end 60, a throat of 2 millimeters and an exit end 60 with a rectangular opening of 5 by 12.5 millimeters the pressure drops quickly as one goes downstream from the throat 58. The measured pressures were: 14.5 psi at 1 inch after the throat 58; 20 psi at 2 inches from the throat 58; 12.8 psi at 3 inches from the throat 58; 9.25 psi at 4 inches from the throat 58; 10 psi at 5 inches from the throat 58 and below atmospheric pressure beyond 6 inches from the throat 58. These results show why one can use much lower pressures to inject the powder when the injection takes place after the throat 58. The low pressure powder feeder 30 that can be used with the nozzle 54 of FIG. 3 has a cost that is approximately ten-fold lower than the high pressure powder feeders 30 that need to be used with the nozzle 34 of FIG. 2. Generally, the low pressure powder feeder 30 is used at a pressure of 100 psi or less. All that is required is that it exceed the main gas pressure at the point of injection.

The system 10 of the present invention differs from the prior art systems because it can operate in two modes. In a first mode it operates as a typical kinetic spray system. In a second mode it operates as a thermal spray system. This dual mode capacity is made possible by using an air heater 32 that is capable of achieving higher temperatures than a typical kinetic spray system. This higher capacity air heater 32 may require that the main air passage 36, supplemental inlet lines 48, tubes 50 and nozzle 34 be made of high heat resistant materials.

When operating in the kinetic spray mode the computer control 35 and the thermocouple 44 interact to monitor and maintain the main gas at a temperature that is always insufficient to cause melting in the nozzle 34 of any particles being sprayed. Even in this mode, the main gas temperature can be well above the melt temperature of the particles and may range from at least 300 to at least 3000 degrees Celsius. Main gas temperatures that are 5 to 7 fold above the melt temperature of the particles have been used in the present system 10. What is necessary is that the temperature and exposure time to the main gas be selected such that the particles do not melt in the nozzle 34. The temperature of the gas rapidly falls as it travels through the nozzle 34. In fact, the temperature of the gas measured as it exits the nozzle 34 is often at or below room temperature even when its initial temperature is above 1000° F.

Since in the kinetic mode the temperature of the particles is always less than the melting point of the particles, even upon impact on a substrate placed opposite the nozzle 34, there is no change in the solid phase of the original particles due to transfer of kinetic and thermal energy, and therefore no change in their original physical properties.

Upon striking a substrate opposite the nozzle 54 the kinetic sprayed particles flatten into a nub-like structure with an aspect ratio of generally about 5 to 1. When the substrate is a metal and the particles are a metal the particles striking the substrate surface fracture the oxidation on the surface layer and subsequently form a direct metal-to-metal bond between the metal particle and the metal substrate. Upon impact the kinetic sprayed particles transfer substantially all of their kinetic and thermal energy to the substrate surface and stick if their yield stress has been exceeded. As discussed above, for a given particle to adhere to a substrate during the kinetic spray mode it is necessary that it reach or exceed its critical velocity which is defined as the velocity where at it will adhere to a substrate when it strikes the substrate after exiting the nozzle. This critical velocity is dependent on the material composition of the particle. In general, harder materials must achieve a higher critical velocity before they adhere to a given substrate. It is not known at this time exactly what is the nature of the particle to substrate bond; however, it is believed that a portion of the bond is due to the particles plastically deforming upon striking the substrate.

As disclosed in U.S. Pat. No. 6,139,913 the substrate material may be comprised of any of a wide variety of materials including a metal, an alloy, a semi-conductor, a ceramic, a plastic, and mixtures of these materials. Other substrates include wood and paper. All of these substrates can be coated by the process of the present invention in either mode of operation. The particles used in the present invention may comprise any of the materials disclosed in U.S. Pat. Nos. 6,139,913 and 6,283,386 in addition to other known particles. These particles generally comprise metals, alloys, ceramics, polymers, diamonds and mixtures of these. Preferably the particles used have an average nominal diameter of from 60 to 250 microns. Mixtures of different sized or different material compositions of particles can also be used in the system 10 either by providing them as a mixture or using multiple tubes 50 and the nozzle 54 shown in FIG. 3.

When the system 10 is operating in the thermal spray mode the computer control 35 and the thermocouple 44 interact to monitor and maintain the main gas at a temperature that is always sufficient to cause melting in the nozzle 34 of any particles being sprayed. Thus, the particles exit the nozzle 34 in a molten state and strike the substrate while molten. After striking the substrate the molten particles flatten and adhere to the substrate. The system 10 allows one to thermally spray the same types of particles onto the same types of substrates. During a given coating operation the system 10 can be oscillated between the two modes as desired. Preferably when in the thermal spray mode the system 10 heats the particles to a temperature of from the melting point of the particles to 400 degrees Celsius above the melting point of the particles, more preferably from the melting point of the particles to 200 degrees Celsius above the melting point of the particles, and most preferably from the melting point of the particles to 100 degrees Celsius above the melting point of the particles. To accomplish this the air heater 32 is selected to have a higher heating capacity. The air heater 32 can comprise any of a number of designs including a thermal plasma heater, it may include a combustion chamber, and it may be a high temperature resistive heater element. All of these systems are known in the art. The air heater 32 just needs to be able to oscillate between the kinetic spray mode and the thermal spray mode and to be able to heat the particles to temperatures above their melt points during their passage through the nozzle 34 for the thermal spray mode.

The system 10 permits a user to solve two difficulties with conventional kinetic spray systems, namely healing defective kinetic spray coatings and permitting kinetic spray coatings on softer materials. As discussed in the background above, one problem with kinetic spray systems is that if the substrate surface has any defects or imperfections these can cause conical defects in the kinetic spray applied coating. The defects appear as a right circular cone. This defect is stable in that with continued kinetic spray application the defect just becomes more evident. With a typical kinetic spray system the coating would have to be discarded and a new one begun. With the present system 10 this problem can be solved in two ways. First, the substrate can be sprayed initially in the thermal spray mode to provide a thin coating that covers the surface defects and provides a better surface, which allows kinetically sprayed particles to plastically deform and bond to the better surface, then the system 10 can be switched into the kinetic spray mode to build up a kinetic spray coating on the substrate. Second, should defects become evident during the coating process while the system 10 is operating in the kinetic spray mode, the system 10 can be oscillated into the thermal spray mode to "heal" the defect by filling it in and then the system 10 can be returned to the kinetic spray mode. In this fashion, because the time in the thermal spray mode is relatively short, the substrate is not subjected to the large thermal stresses that can occur with prolonged thermal spray application. Some of this thermal stress Would be relieved by the subsequent peening effect of the kinetically sprayed particles.

The system 10 also allows a user to apply a kinetic spray coating to soft materials. Such materials may comprise certain plastics and ceramic composites. With a conventional kinetic spray system some of these materials can not be coated because the particles tend to bury themselves below the surface of the substrate rather than plastically deforming and coating the substrate. With the present system 10 a user initially applies a thin coating of the particles in the thermal spray mode and then oscillates to the kinetic spray mode to complete the coating.

An additional advantage of the nozzle 54 shown in FIG. 3 is that by injecting the particles after the throat 58 the potential for plugging the throat 58 is avoided. Plugging of the throat 58 can occur with the nozzle 54 design shown in FIG. 2.

While the preferred embodiment of the present invention has been described so as to enable one skilled in the art to practice the present invention, it is to be understood that variations and modifications may be employed without departing from the concept and intent of the present invention as defined in the following claims. The preceding description is intended to be exemplary and should not be used to limit the scope of the invention. The scope of the invention should be determined only by reference to the following claims.

What is claimed is:

1. A method of coating a substrate comprising the steps of:

a) providing particles of a material to be sprayed;

b) providing a supersonic nozzle having a throat located between a converging region and a diverging region, directing a flow of a gas through the nozzle, and injecting the particles into the nozzle and entraining the particles in the flow of the gas;

c) maintaining the gas at a temperature insufficient to heat the particles to a temperature at or above their melting temperature in the nozzle and accelerating the particles to a velocity sufficient to result in adherence of the particles on a substrate positioned opposite the nozzle; and d) maintaining the gas at a temperature sufficiently high to heat the particles to a temperature at or above their melting temperature in the nozzle thereby melting the particles and entraining the molten particles in the flow of the gas and directing the entrained molten particles at a substrate positioned opposite the nozzle.

2. The method of claim 1, wherein step a) comprises providing particles having an average nominal diameter of from 50 to 250 microns.

3. The method of claim 1, wherein step a) comprises providing particles having an average nominal diameter of from 106 to 250 microns.

4. The method of claim 1, wherein step a) comprises providing at least two different types of particles differing in at least one of size or material composition.

5. The method of claim 1, wherein step b) comprises providing air, argon, nitrogen, or helium as the gas.

6. The method of claim 1, wherein step c) comprises providing the gas at a temperature of from 300 degrees Celsius to a temperature that is seven fold above the melting temperature of the particles.

7. The method of claim 1, wherein step b) comprises injecting the particles into the converging region of the nozzle prior to the throat.

8. The method of claim 1, wherein step b) comprises injecting the particles directly into the diverging region of the nozzle after the throat.

9. The method of claim 1, wherein step b) comprises injecting a plurality of different types of particles differing in at least one of size or material composition directly into the diverging region each at a different location.

10. The method of claim 1, wherein step c) comprises accelerating the particles to a velocity of from 300 to 1500 meters per second.

11. The method of claim 1, wherein step d) comprises heating the particles to a temperature of from their melting temperature to a temperature 400 degrees Celsius above their melting temperature.

12. The method of claim 1, wherein step d) comprises heating the particles to a temperature of from their melting temperature to a temperature 200 degrees Celsius above their melting temperature.

13. The method of claim 1, wherein step d) comprises heating the particles to a temperature of from their melting temperature to a temperature 100 degrees Celsius above their melting temperature.

14. The method of claim 1, wherein step c) is carried out prior to step d) to produce a laminate on the substrate of a kinetic spray applied layer and a thermal spray applied layer.

15. The method of claim 1, wherein step d) is carried out prior to step c) to produce a laminate on the substrate of a thermal spray applied layer and a kinetic spray applied layer.

16. The method of claim 1, wherein steps c) and d) comprise positioning a substrate comprising a metal, an alloy, a ceramic, a plastic, a semi-conductor, wood, paper, or mixtures thereof opposite the nozzle.

17. The method of claim 1, wherein step a) comprises providing particles comprising a metal, an alloy, a ceramic, a polymer, or mixtures of thereof.

18. The method of claim 1, wherein step b) comprises injecting the particles through a tube having an inner diameter of from 0.4 to 3.0 millimeters in diameter.

19. The method of claim 1, wherein step b) comprises providing a nozzle having a diverging region with a length of from 60.0 to 400.0 millimeters in length.

20. The method of claim 1, wherein step b) comprises providing a nozzle having a throat with a diameter of from 1.5 to 3.5 millimeters.

* * * * *